US007412951B2

(12) United States Patent
Werler et al.

(10) Patent No.: US 7,412,951 B2
(45) Date of Patent: Aug. 19, 2008

(54) VALVE GEAR FOR LOAD CHANGE VALVES OF FOUR-STROKE INTERNAL COMBUSTION ENGINES

(75) Inventors: Andreas Werler, Zwickau (DE); Jörg Wutzler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 279 days.

(21) Appl. No.: 11/494,203

(22) Filed: Jul. 27, 2006

(65) Prior Publication Data

US 2007/0022990 A1 Feb. 1, 2007

(30) Foreign Application Priority Data

Jul. 28, 2005 (DE) ..... 10 2005 035 314

(51) Int. Cl.
*F01L 1/34* (2006.01)

(52) U.S. Cl. ..... 123/90.16; 123/90.15

(58) Field of Classification Search ..... 123/90.16, 123/90.15

See application file for complete search history.

(56) References Cited

U.S. PATENT DOCUMENTS 5,603,292 A 2/1997 Håkansson
7,207,311 B2 4/2007 Chmela et al.
2003/0226530 A1* 12/2003 Werler ..... 123/90.16
2004/0221831 A1 11/2004 Chmela et al.

FOREIGN PATENT DOCUMENTS

| | | |
|---|---|---|
| CH | 306 146 | 3/1955 |
| DE | 411 706 | 4/1925 |
| DE | 27 28 259 | 1/1979 |
| DE | 32 18 507 | 12/1982 |
| DE | 69414386 T2 | 4/1999 |
| DE | 103 48 366 | 5/2004 |
| DE | 20220138 U1 | 6/2004 |
| WO | WO 03/067067 | 8/2003 |
| WO | WO2004/088096 | 10/2004 |

* cited by examiner

*Primary Examiner*—Zelalem Eshete
(74) *Attorney, Agent, or Firm*—Collard & Roe, P.C.

(57) ABSTRACT

Valve gears for load-change valves of four-stroke internal combustion engines, in which the load-change valves are closed by spring force, engage a pivot lever moved by a cam for opening a load-change channel. The cam engages an intermediate element that it is additionally moved by the lifting curve of the cam during a different work cycle, and adjusts the pivot lever to open the load-change valve slightly during a different work cycle. The intermediate element is prismatically guided on an element that can pivot in the cylinder head and is adjustable in its position, and engages the cam and the pivot lever, so that the stroke movement of the cam for opening the load-change valve via the pivot lever can be adjusted.

6 Claims, 4 Drawing Sheets

VALVE GEAR FOR LOAD CHANGE VALVES OF FOUR-STROKE INTERNAL COMBUSTION ENGINES

BACKGROUND OF THE INVENTION

1. Field of the Invention

The invention relates to valve gears for load-change valves of four-stroke internal combustion engines, in which optional opening of the load-change valve during a different work cycle can take place in addition to opening in accordance with the cycle.

2. The Prior Art

A valve gear of this type, for outlet valves, is described in PCT Application Publication No. WO 03/067067, FIG. 2 and FIG. 4. Outlet valves held in the closed position by spring force are opened according to the cycle, in usual manner, by an outlet cam, by way of a toggle or pivot lever, as well as a pressure plate that acts on the stems of the valves, so that the waste gases can flow out of the cylinder chamber into the waste gas tract via the outlet channel at the end of the expansion cycle and during the movement of the piston to the upper dead point. An intermediate element is articulated onto the toggle or pivot lever, so as to pivot. This element is firmly supported against the toggle or pivot lever by a hydraulic pressure cylinder to which pressure can optionally be applied or, if no pressure is applied to the pressure cylinder, can rotate freely about its articulation point. When pressure is applied to the hydraulic pressure cylinder, the outlet cam stands in engagement with the toggle or pivot lever during the intake process, by way of the intermediate element. This lever is moved exclusively by the highest region of the lifting curve of the outlet cam. The outlet valve is therefore additionally opened during the intake process, but this happens with a significantly lesser time cross-section than during expulsion of waste gas. This is shown in FIG. 1 of the PCT application mentioned above.

By means of the additional opening of the outlet valve during the intake process, waste gas gets into the cylinder from the waste gas tract, by way of the outlet channel, and subsequently mixes with air that is drawn in, or with the fuel/air mixture that is supplied, during intake and compression. In order to achieve a slight time cross-section for returning waste gas during the intake cycle of waste gas, only the highest region of the lifting curve of the outlet cam is utilized. This highest region has a lifting characteristic that is configured to be optimal for the return of waste gas. Such a lifting characteristic forms a compromise with regard to an optimal lifting characteristic for the outlet process of waste gases.

It is also disadvantageous that the intermediate element articulated onto the toggle or pivot lever is moved along during all outlet valve movements, i.e., also during the outlet process of the waste gases, without this being functionally necessary.

SUMMARY OF THE INVENTION

It is therefore an object of the invention to provide a a valve gear of the type stated above, which uses a conventional cam, configured for a specific load change, and which creates a transfer device for the movements brought about by this cam, which device permits sensitive adjustment of different time cross-sections in the case of additional opening during a different work cycle.

These and other objects are accomplished by a valve gear for load-change valves of four-stroke internal combustion engines, in which the load-change valves are held in the closed position by means of spring force, and engage a pivot lever moved by a cam, for opening a load-change channel in accordance with the engine cycle. The cam engages an intermediate element, the engagement region of which is positioned on the cam in such a manner that it is additionally moved by the lifting curve of the cam during a different work cycle, and has an adjustable effect on the pivot lever. The load-change valve additionally opens during a different work cycle, but with a lesser time cross-section. The intermediate element is prismatically guided on an element that can pivot in the cylinder head and is adjustable in its position. This element engages the cam and the pivot lever, so that different gear reductions of the stroke movement of the cam for opening the load-change valve with the pivot lever can be adjusted.

The use of an intermediate element, which is guided on an element that can pivot in the cylinder head and is adjustable in its position, makes it possible to set different gear reductions of the stroke movement of the cam, for additionally opening the load-change valve, so that the cam can be guided in an optimized manner, exclusively for the load-change process in question—letting out waste gases or drawing in charge. The stroke movement of the inlet or outlet cam is stepped down adjustably, in accordance with the requirements, by the transfer device described above, with the intermediate element and the element that is adjustable in its position, so that the additional opening of the load-change valve, in each instance—intake or outlet valve—can be regulated in a sensitive manner. This is necessary both for returning waste gas into the cylinder during the intake cycle, by way of an outlet valve, and for returning waste gas into the intake tracts, by way of an inlet valve, during the expulsion of waste gas from the cylinder.

It is advantageous if during opening of each of the load-change valves, in accordance with the cycle, with large opening paths, only the pivot lever is moved, and the intermediate element remains in its resting position. The intermediate element, with its mass, is only moved by the cam for the additional opening.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
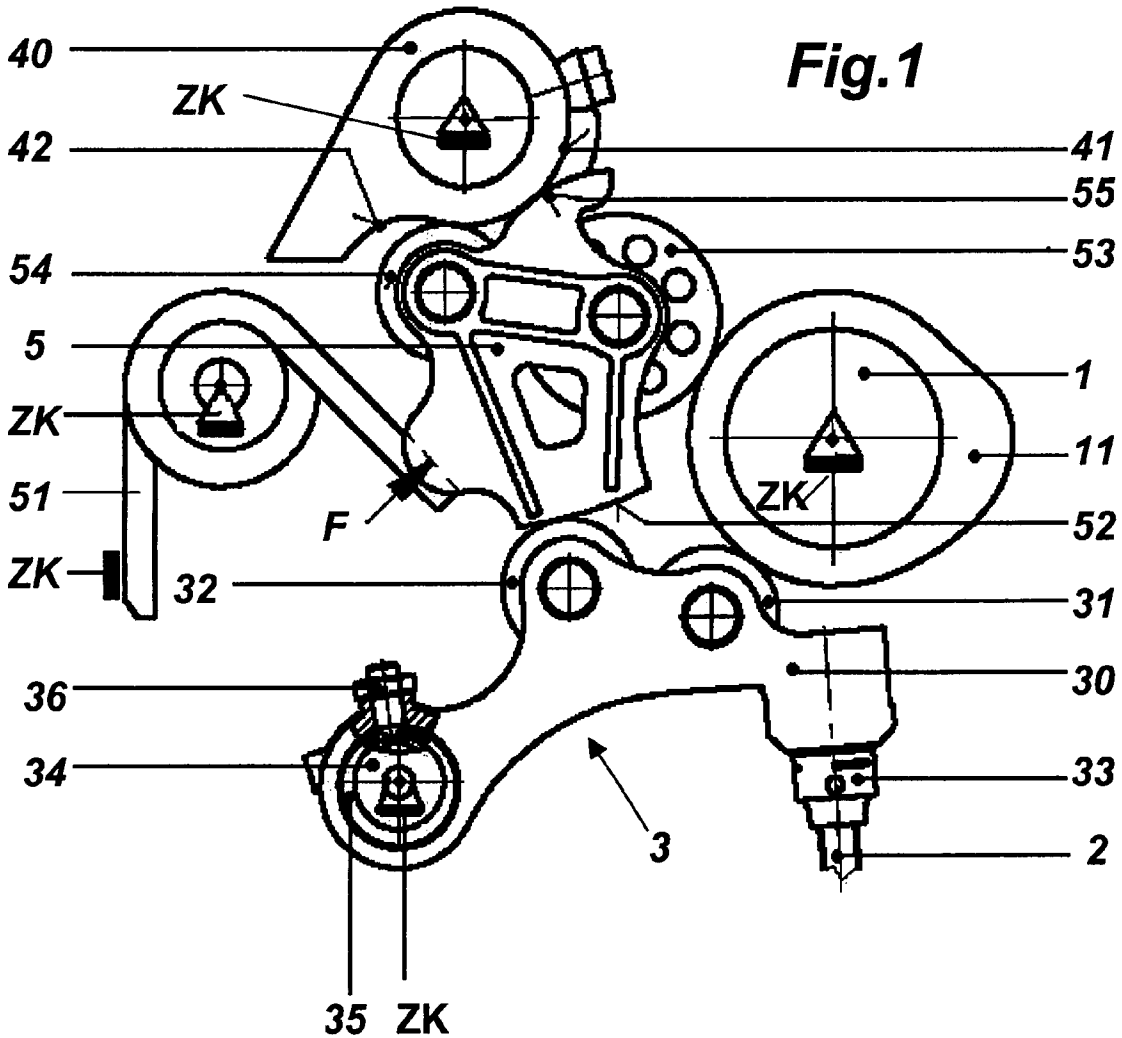
FIG. 1 shows one embodiment of the valve gear according to the invention in a position before opening of the load-change valve, which is an outlet valve here.

Referring to the drawings, FIG. 1 shows a side view of the elements of one embodiment of the valve gear according to the invention, with a view in the direction of the progression of the camshaft axis. A camshaft 1, driven by the crankshaft, if necessary by way of an angle adjustment device, is mounted to rotate in the cylinder head ZK, fixed in place, and turns in the clockwise direction in all of the views. Camshaft 1 has cams 11 whose lifting curve and angular position relative to the crankshaft are adapted to letting out and expelling waste gases. Accordingly, load-change valve 2 activated by the valve gear is an outlet valve.

A guided stroke transfer arrangement 3, fixed in place, having a pivot lever 30 is assigned to load-change valve 2 disposed in cylinder head ZK, in each instance, which valve closes by means of spring force. Only the end part of the valve stem is shown in FIG. 1. The end surface of the valve stem rests against a play equalization element 33 disposed in pivot lever 30. Pivot lever 30 is constantly forced against the running surface of cam 11, with its roller 31, without play, by means of the force of said element. Roller 31 mounted on pivot lever 30 therefore forms a first engagement surface on pivot lever 30.

Pivot lever 30 is mounted adjustably on an axle 34 guided in cylinder head ZK, with the interposition of an eccentric bushing 35. An intermediate element 5 is positioned relative to cam 11 with a roller 53 mounted on it, in such a manner that roller 53 comes into engagement with the lifting curve of cam 11 during the intake process, in other words only after expulsion of the waste gases. By means of this arrangement, intermediate element 5 is moved by cam 11 exclusively during the intake process. An element 40 that is fixed in place in cylinder head ZK, but can be adjusted in its position about a rigidly positioned pivot axle, and intermediate element 5 together form a transfer device 6, which is actually known (see FIGS. 2 and 3) for differently adjustable gear reduction of the stroke movement of cam 11 during transfer to the pivot lever 30 and load-change valve 2.

Intermediate element 5 engages element 40, which is changeable in its position, in a non-positive lock, on the controlling cam segment 42 of element 40, by way of roller 54 mounted on it, as well as with line contact on a supporting cam segment 41, by slide supports 55. The outer contour of the supporting cam segments 41 forms an arc about the pivot axle of element 40 in cylinder head ZK. This arrangement forms a prismatic support of intermediate element 5 on element 40 that is changeable in its position, and thereby assures guidance of intermediate element 5 in every phase of a movement brought about by cam 11.

Under the effect of force F of a spiral spring 51 countermounted and guided on cylinder head ZK in a fixed position, intermediate element 5 is constantly forced both against changeable element 40 with its roller 54 and its slide supports 55, and against cam 11 with its roller 53, and held in engagement.

Intermediate element 5 furthermore has an outer contour 52 that engages a second roller 32 on pivot lever 30. Roller 32 therefore forms a second engagement surface on pivot lever 30, which comes into engagement exclusively for opening load-change valve 2 during the intake process, see FIG. 3.

By means of transfer device 6, sensitively controlled opening of load-change valve 2 with lesser time cross-sections can be achieved, for returning waste gas from the waste gas tract into the cylinder, during the intake process.

Figure 3:
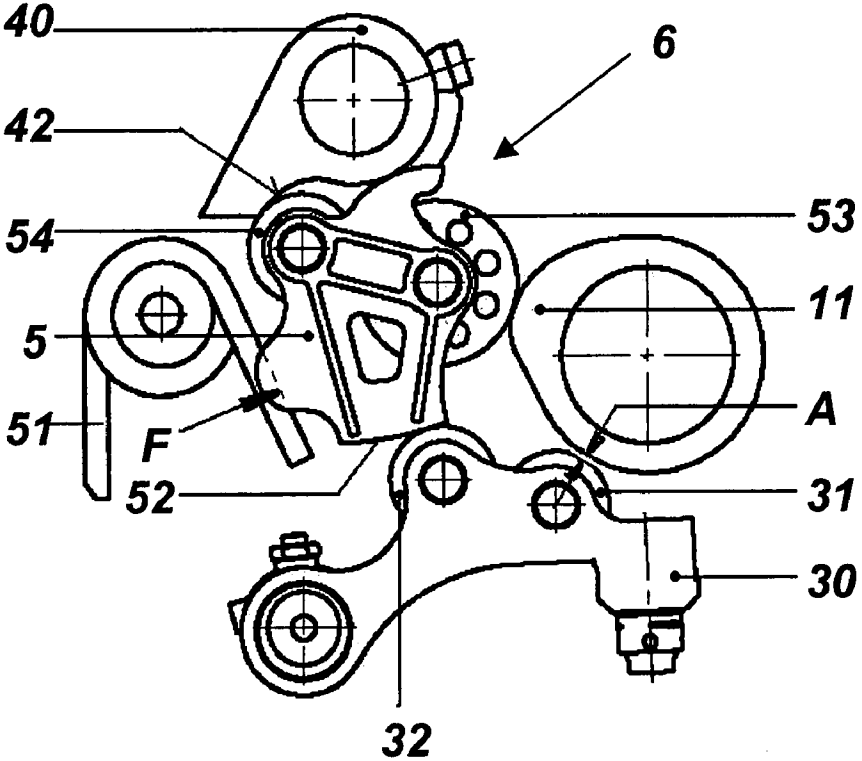
FIG. 3 shows an embodiment of the valve drive according to the invention in a position during the intake cycle, with the outlet valve slightly open.
Figure 2:
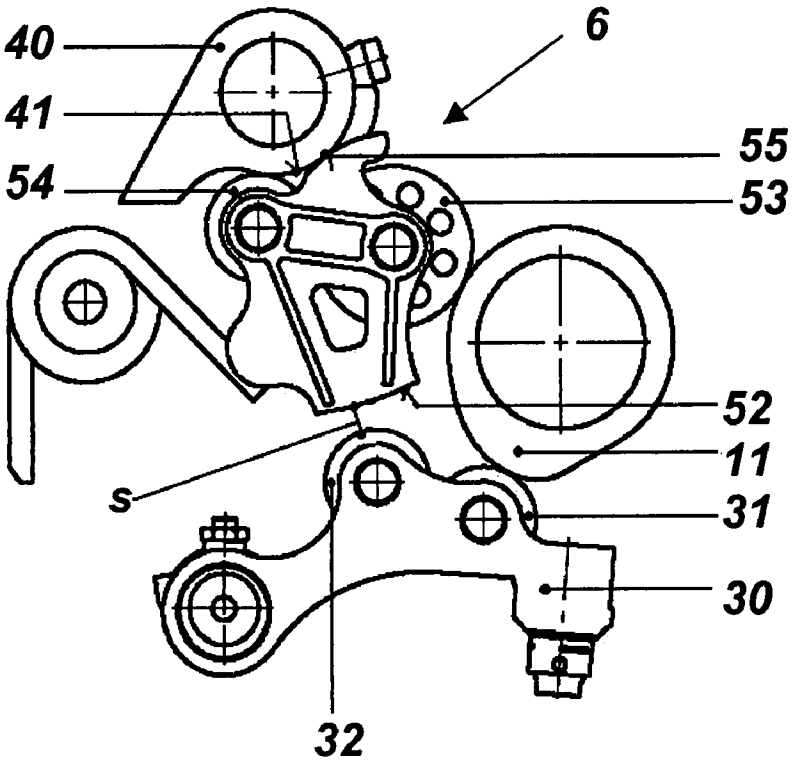
FIG. 2 shows an embodiment of the valve gear according to the invention in a position with the outlet valve fully open, during expulsion of the waste gases.

Fundamentally, the structure of transfer device 6—see FIGS. 2 and 3—and its function for varying the valve stroke is already previously known from German Patent No. DE 202 20 138 U1, the disclosure of which is herein incorporated by reference.

Eccentric bushing 35 disposed between axle 34, which is fixed in place, and the bearing bore of pivot lever 30, adjusts the engagement play between outer contour 52 on intermediate element 5 and roller 32 on pivot lever 30. The eccentric bushing 35 is clamped in place in the bearing bore of pivot lever 30 after the aforementioned engagement play has been adjusted, by means of a clamp screw arrangement 36 in pivot lever 30.

The device according to the invention functions as follows:

In FIG. 1, load-change valve 2 is closed, roller 31 of pivot lever 30 and roller 53 on intermediate element 5 stand in engagement with the base circle of cam 11. When cam 11 turns further, from the aforementioned position, in the clockwise direction, roller 31 is first constantly forced in the direction of valve opening by its lifting, until the outermost cam contour has been reached, see FIG. 2, and load-change valve 2 is always opened with a constant stroke. Roller 32 on pivot lever 30 moves away from its engagement region on outer contour 52 of intermediate element 5, which does not move, when load-change valve 2 is fully open, by a distance segment S, because roller 53 of element 5 runs on the base circle of cam 11 at this point in time.

According to the functional position shown in FIG. 2, load-change valve 2 is subsequently closed by means of a spring force, whereby roller 31 of pivot lever 30 comes back to the base circle of cam 11. With this, the engagement play that is adjusted by the eccentric bushing 35, between outer contour 52 on the intermediate element 5 and roller 32 on pivot lever 30, is also present again. As cam 11 rotates further, its lifting moves roller 53 and therefore intermediate element 5, until the outermost cam contour is reached. Depending on the position of element 40, which is changeable in its position, intermediate element 5 is forced, to a greater or lesser degree, in the direction of valve opening, by the controlling cam segment 42, by way of its roller 54 with its outer contour 52, against roller 32 of pivot lever 30, see FIG. 3.

In FIG. 3, a slight opening of load-change valve 2 for waste gas return is adjusted, as can be seen from distance segment A, lifting roller 31 of pivot lever 30 from the base circle of cam 11. If adjustable element 40 were moved further out of the position shown in FIG. 3, in the counter-clockwise direction, load-change valve 2 would be opened more than in FIG. 3, because intermediate element 5, with its roller 54, would be pushed more onto controlling cam segment 42, and therefore the intermediate element 5, with its outer contour 52, would also be displaced more against roller 32 of pivot lever 30. The distance segment A would then be greater than that in FIG. 3.

After the highest lifting of cam 11 on roller 53 has gone by, the force F of spiral spring 51 and the return force of the valve spring forces pivot lever 30 and intermediate element 5 back in the direction of the base circle of cam 11, by way of play equalization element 33. Finally, roller 31 mounted on pivot lever 30 comes back into non-positive-lock engagement with the base circle of cam 11.

Figure 4:
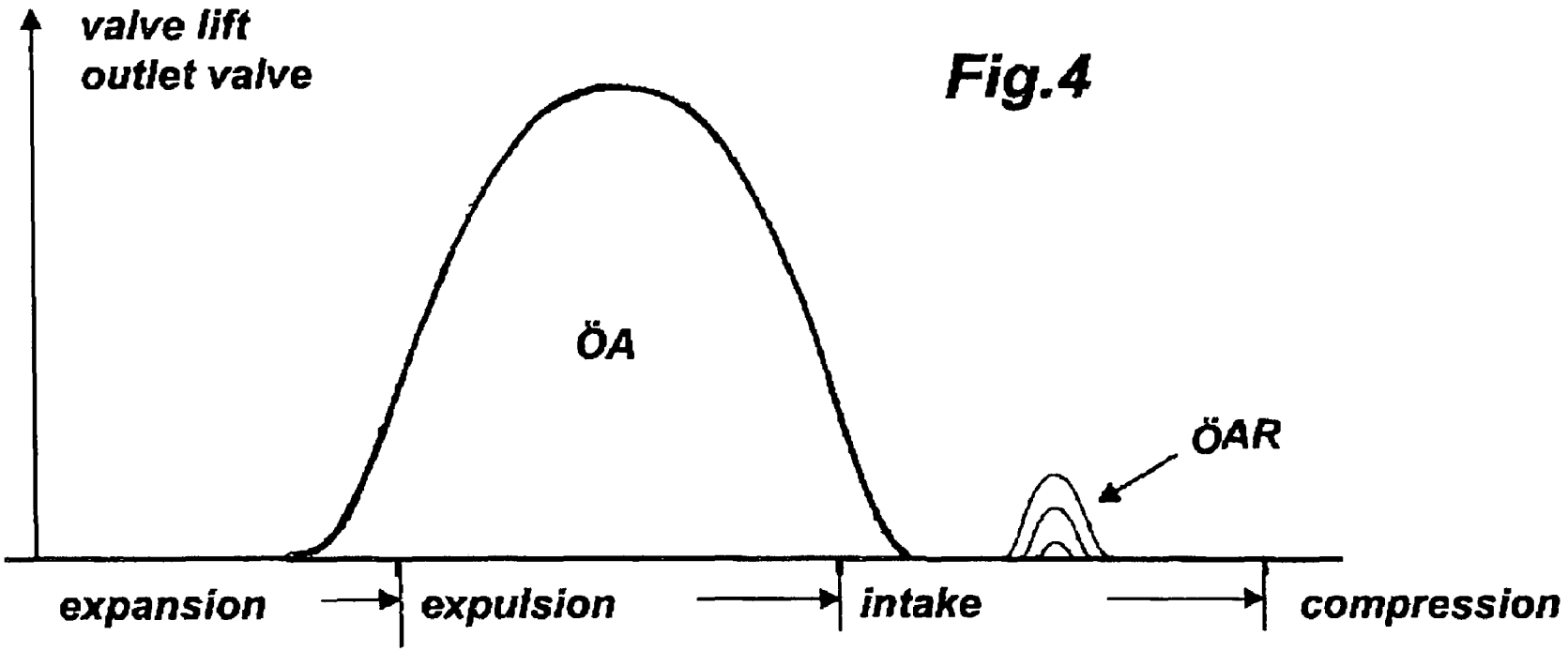
FIG. 4 shows the valve lifting curve determined by an outlet cam with an embodiment of the valve gear according to the invention for the outlet valve, and the valve lifting curves that can be additionally adjusted during the intake cycle.

FIG. 4 shows valve lifting curves that can be achieved with the valve gear according to the invention, for a load-change valve 2, which is an outlet valve, in this case, with their location in the cycle regions of a four-stroke engine. Cam 11 always opens load-change valve 2 at a constant stroke, at the end of the expansion cycle and during expulsion, see ÖA. Adjustable opening of load-change valve 2, see group of curves ÖAR, can take place even during intake, by way of intermediate element 5 of transfer device 4. Return of waste gases from the waste gas tract into the cylinder is achieved in this way. If waste gas return is undesirable, opening of load-change valve 2 is prevented by transfer device 6, it remains in the closed state.

Figure 5:
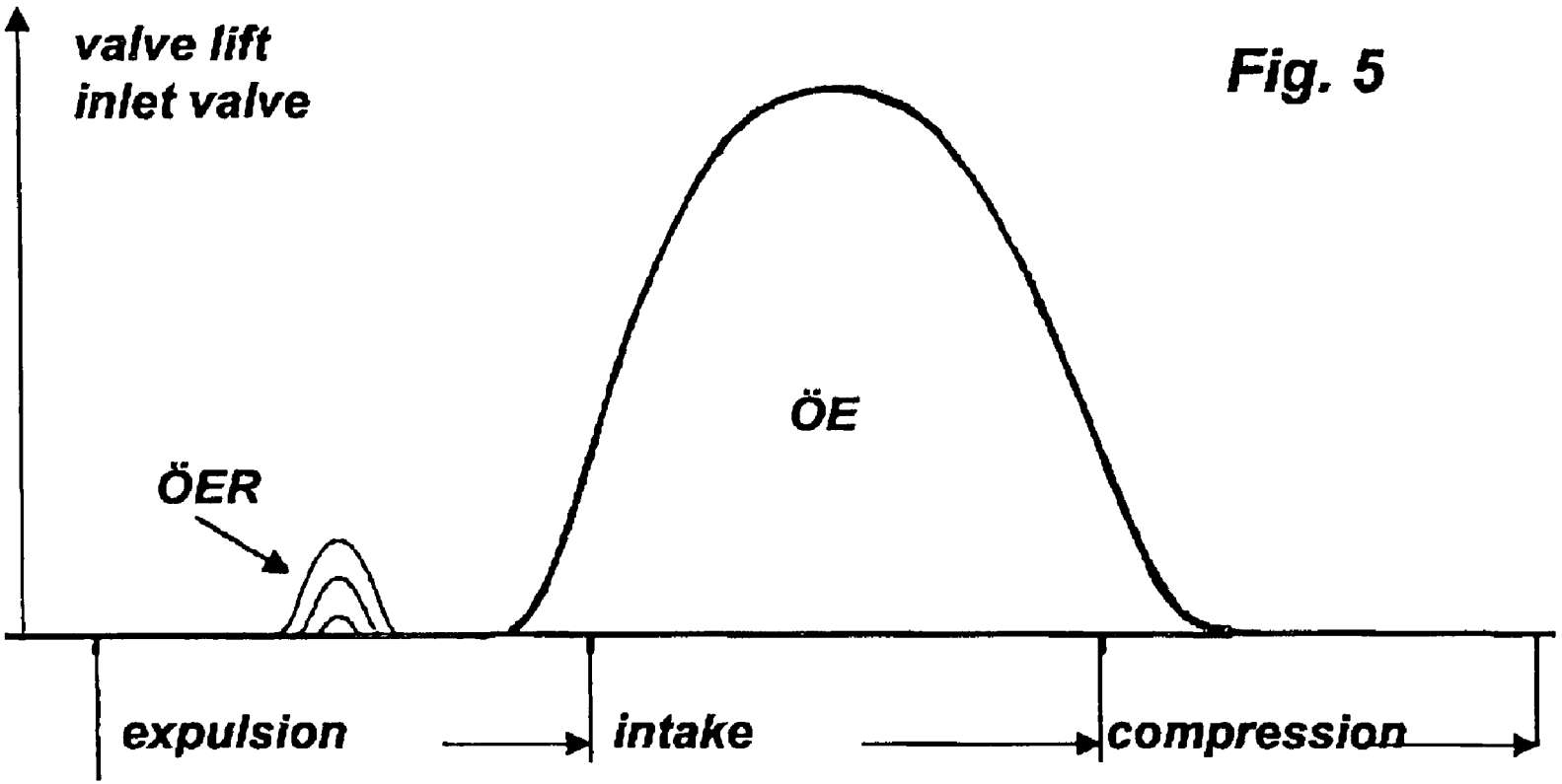
FIG. 5 shows the valve lifting curve determined by an inlet cam with an embodiment of the valve gear according to the invention for an inlet valve, during the intake cycle, and the valve lifting curves that can be additionally adjusted during the cycle, for expulsion of the waste gases.

In FIG. 5, the valve lifting curves that can be achieved with the valve gear according to the invention for a load-change valve acting as an inlet valve are shown. Cam 11 is configured as an inlet cam, and camshaft 1 turns counter-clockwise, in contrast to the embodiment described above. During the cycle—expulsion of waste gas—lifting of cam 11 reaches roller 53 and displaces intermediate element 5 until the outermost cam contour is reached. Depending on the position of element 40 that is changeable in position, intermediate element 5 is forced in the direction of opening, to a greater or lesser degree, by means of controlling cam section 42, by way of its roller 54 with its outer contour 52, against roller 32 of pivot lever 30, see FIG. 3, so that the lifting curves ÖER shown in FIG. 5 can be adjusted for the inlet valve. Thus, the return of waste gas into the intake tract, by way of the inlet valve, during expulsion of waste gas from the cylinder, can be regulated in a sensitive manner. As camshaft 1 turns further, cam 11 engages roller 31 on pivot lever 30—see FIG. 2—and opens load-change valve 2, which is acting as an inlet valve, in usual manner, before the beginning of the intake cycle until the beginning of the compression cycle, always at a constant stroke, see ÖE in FIG. 5.

Accordingly, while only a few embodiments of the present invention have been shown and described, it is obvious that many changes and modifications may be made thereunto without departing from the spirit and scope of the invention.

REFERENCE SYMBOLS

1 camshaft
11 cam (inlet or outlet cam)
2 load-change valve (inlet or outlet cam)
3 lift transfer arrangement
30 pivot lever
31 roller
32 roller
33 play equalization element
34 axle for mounting 30
35 eccentric bushing
36 clamp screw arrangement in 30 for 35
4 transfer device
40 element that is changeable in its position, can pivot
41 supporting cam segment
42 controlling cam segment
5 intermediate element
51 spiral spring
52 outer contour
53 roller
54 roller
55 slide support
6 transfer device for the additional opening of 2 brought about by 11
A distance segment
F force of 51 that engages at 5 and holds 5 against 4 and 11 with a non-positive lock
ÖA opening of 2 (outlet valve) for letting out and expelling waste gas
ÖAR group of curves during opening of 2 (outlet valve) for returning waste gas during the intake cycle
ÖE opening of 2 (inlet valve) for intake
ÖER lifting curves during opening of 2 (inlet valve) for returning waste gas into the intake cycle during expulsion of waste gas
S distance segment
ZK cylinder head

What is claimed is:

1. A valve gear for load-change valves of a four-stroke internal combustion engine having a cylinder head, in which the load-change valves are held in a closed position by spring force, the valve gear comprising:

a pivot lever connected to the load-change valve;

a cam connected to the cylinder head and having a lifting curve, the cam contacting the pivot lever and rotating to move the pivot lever to open a load-change channel during a first work cycle;

an intermediate element engaged by the cam, an engagement region of said intermediate element being positioned on the cam so that the intermediate element is moved by the lifting curve of the cam during rotation of the cam, and adjusts the pivot lever, to open the load-change valve during a second work cycle, wherein the load-change valve is opened to a lesser degree during said second work cycle than during said first work cycle; and an element that can pivot in the cylinder head and is adjustable in its position, said element engaging the cam and the pivot lever, and prismatically guiding the intermediate element, so that a stroke movement of the cam for opening the load-change valve via the pivot lever can be adjusted.

2. A valve gear according to claim 1, wherein the load-change valve is an outlet valve, and the cam acts as an outlet cam and first engages a stroke transfer device for opening the valve in the first work cycle, and only afterwards engages the intermediate element in the second work cycle.

3. A valve gear according to claim 1, wherein the load-change valve is an inlet valve and the cam acts as an inlet cam and first engages the intermediate element for opening the valve during the second work cycle, and only afterwards engages a stroke transfer device for opening in accordance with the first work cycle.

4. A valve gear according to claim 1, wherein the intermediate element constantly engages the cam and a supporting and controlling cam segment on the adjustable element, by means of a fixed spiral spring that contacts the intermediate element.

5. Valve gear according to claim 1, wherein the pivot lever is mounted on an axle via an adjustable eccentric bushing that can be fixed in place relative to a bearing bore of the pivot lever, and wherein engagement play between an outer contour on the intermediate element and a roller on the pivot lever is adjustable via said eccentric bushing.

6. A valve gear according to claim 5, wherein the pivot lever has a clamp screw in the bearing bore, for fixing the eccentric bushing in place.

* * * * *